United States Patent [19]

Russo et al.

[11] Patent Number: 4,751,624

[45] Date of Patent: Jun. 14, 1988

[54] SAFETY CEILING FIXTURE WITH HEAT SENSOR

[75] Inventors: Neil Russo, Howell, N.J.; Kingsley Chan, Rolling Hills Estate, Calif.

[73] Assignee: Lightolier Incoporated, Secaucus, N.J.

[21] Appl. No.: 132,968

[22] Filed: Dec. 14, 1987

[51] Int. Cl.[4] ..... F21V 25/10

[52] U.S. Cl. ..... 362/276; 362/364; 362/802

[58] Field of Search ..... 362/147, 276, 364, 373, 362/802, 295; 337/113

[56] References Cited

U.S. PATENT DOCUMENTS

| | | | |
|---|---|---|---|
| 3,313,931 | 4/1967 | Klugman | 362/364 X |
| 4,104,713 | 8/1978 | Chan et al. | 362/294 |
| 4,313,154 | 1/1982 | Capostagno et al. | 362/404 X |
| 4,420,802 | 12/1983 | Smester et al. | 362/364 |
| 4,450,512 | 5/1984 | Kristofek | 362/364 X |
| 4,460,944 | 7/1984 | Gordbegli et al. | 362/802 X |
| 4,577,266 | 3/1986 | Donato et al. | 362/365 X |
| 4,635,172 | 1/1987 | Steinke | 362/365 |
| 4,685,037 | 8/1987 | Akiyima et al. | 362/365 X |

*Primary Examiner*—Ira S. Lazarus
*Assistant Examiner*—Peggy Neils

[57] ABSTRACT

A recessed incandescent ceiling light fixture is provided with a heat sensing device for interrupting current flow to an incandescent bulb mounted in the fixture. The top wall of the fixture is encompassed within a cover member which is spaced from the top wall, the cover member including a depending skirt which outwardly laps the sidewalls of the fixture and defines a circumferential slot between the fixture walls and cover member. A heat sensor is mounted on the surface of the cover member in the area between the top wall of the housing and cover member. The cover member is mounted to the housing at spaced points whereby heat transfer from the housing to the cover member is minimized.

3 Claims, 2 Drawing Sheets

SAFETY CEILING FIXTURE WITH HEAT SENSOR

FIELD OF INVENTION

The present invention is directed to an improved ceiling fixture, and is directed more particularly to an incandescent lighting fixture having a thermal protector means and adapted to be used in installations where the surfaces of the fixture above ceiling level may be encompassed within thermal insulation.

THE PRIOR ART

As conducive to an understanding of the present invention it should be recognized that in many instances ceiling fixtures are installed in areas where there is limited ventilation surrounding the uppermost portions of the fixture which are exposed above the level of the ceiling or where thermal insulation is packed around the fixture. As a result, there is often substantial heat build-up with consequent danger of combustion, particularly where flammable materials are disposed in proximate relation to the upper end of the fixture housing or where cellulose insulation is employed.

In recognition of the danger of combustion, it has become increasingly common in the design of recessed lighting fixtures to provide for protection aganist fire. A preferred means of avoiding combustion has been to dispose a heat sensor in proximate relation to the fixture housing. Representative examples of lighting fixtures embodying such heat sensors include U.S. Pat. Nos. 4,420,802 of Dec. 13, 1983, 4,450,512 of May 22, 1984, and 4,635,172 of Jan. 6, 1987. In each of the three cited patents, the thermal sensor is disposed either directly within the fixture housing or within a housing disposed adjacent the bulb socket.

In U.S. Pat. No. 4,577,266 of Mar. 18, 1986 there is disclosed a ceiling fixture having a thermal sensor mounted on the junction box displaced a substantial distance from the fixture housing proper.

Fixtures of the type described have not proven altogether satisfactory. Where the thermal sensor has been mounted within the fixture housing, the sensor is often triggered prematurely, i.e. is triggered although the temperature externally of the housing has not reached a dangerous level. In such case the temperature within the housing is sufficiently high to trigger the sensor and thus interrupt current flow to the fixture.

In the device in accordance with the above cited U.S. Pat. No. 4,557,266, the sensor is displaced sufficiently far from the fixture that it is possible that temperatures may reach a dangerous level in areas immediately adjacent the fixture without triggering the sensor.

Other patents of possible relevance to the invention of the instant application comprise U.S. Pat. No. 3,313,931 which discloses a telescoping recessed lighting fixture and U.S. Pat. No. 4,104,713 which discloses a surface mounted lighting fixture having heat dissipating means.

SUMMARY OF THE INVENTION

The present invention may be summarized as directed to an improved ceiling mounted recessed lighting fixture. A characterizing feature of the present invention resides in a construction which assures that the thermal sensor will be triggered when temperatures externally of the fixture housing reach a dangerous level, but which minimizes or eliminates the possibility of false triggering of the thermal sensor mechanism.

More particularly, the present invention is directed to a recessed lighting fixture having a housing comprised of side walls and a top wall. A cover member is mounted above the top wall and includes a depending skirt portion which extends downwardly below the level of the top wall, the skirt being spaced from the side walls of the housing to define a circumferential downwardly directed slot. A thermal sensor device is mounted in the space between the cover and top wall of the housing, the sensor being fixed in heat transmitting relation to the cover member described. The cover member is mounted to the housing with minimal metal to metal contact, whereby heat conduction between the housing and cover member is minimized. The fixture is particulary adapted for use in installations where thermal insulation is packed about the upper portions of the fixture.

It has been discovered that by disposing the heat sensor in the manner described, the sensor will be reliably triggered when temperatures externally of the cover reach a predetermined high value, while at the same time false or improper triggering of the sensor is minimized.

It is accordingly an object of the present invention to provide an improved recessed ceiling fixture which includes heat sensor means for interrupting current flow to the lighting device when temperatures externally of the fixture housing reach a predetermined level. Still a further object of the invention is the provision of a lighting fixture of the type described wherein the possibility of false triggering of the heat sensor is minimized. Still a further object of the invention is the provision of a fixture of the type described wherein the thermal sensor is located inwardly of the confines of the fixture and yet will not respond prematurely or inaccurately to interrupt current flow to the incandescent bulb of the fixture. A still further object of the invention is to provide a fixture particularly adapted to be used in installations where the upper surfaces of the fixture are intimately surrounded by insulation.

DETAILED DESCRIPTION OF THE DRAWINGS

Figure 1:
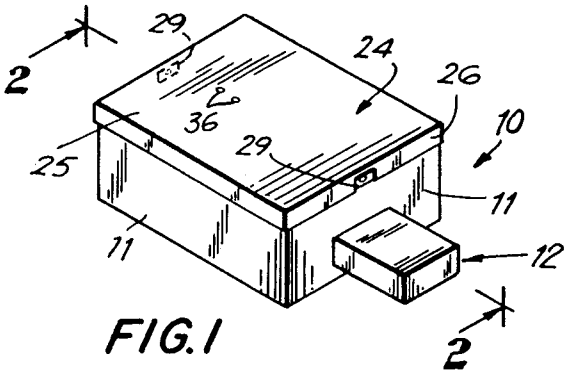
FIG. 1 is a perspective view taken in a downwardly direction of a fixture in accordance of the invention.

Referring now to the drawings, there is disclosed in FIG. 1 a fixture 10 which in the illustrated embodiment is rectangular in plan, it being understood that the present invention is not to be taken as limited to such configuration. The fixture 10 includes side wall portions 11. To one such side wall portion there is releasably mounted a conventional junction box or connector box 12. As is conventional, the junction box 12 may be secured to wall 11 as by spring fingers 13.

Figure 2:
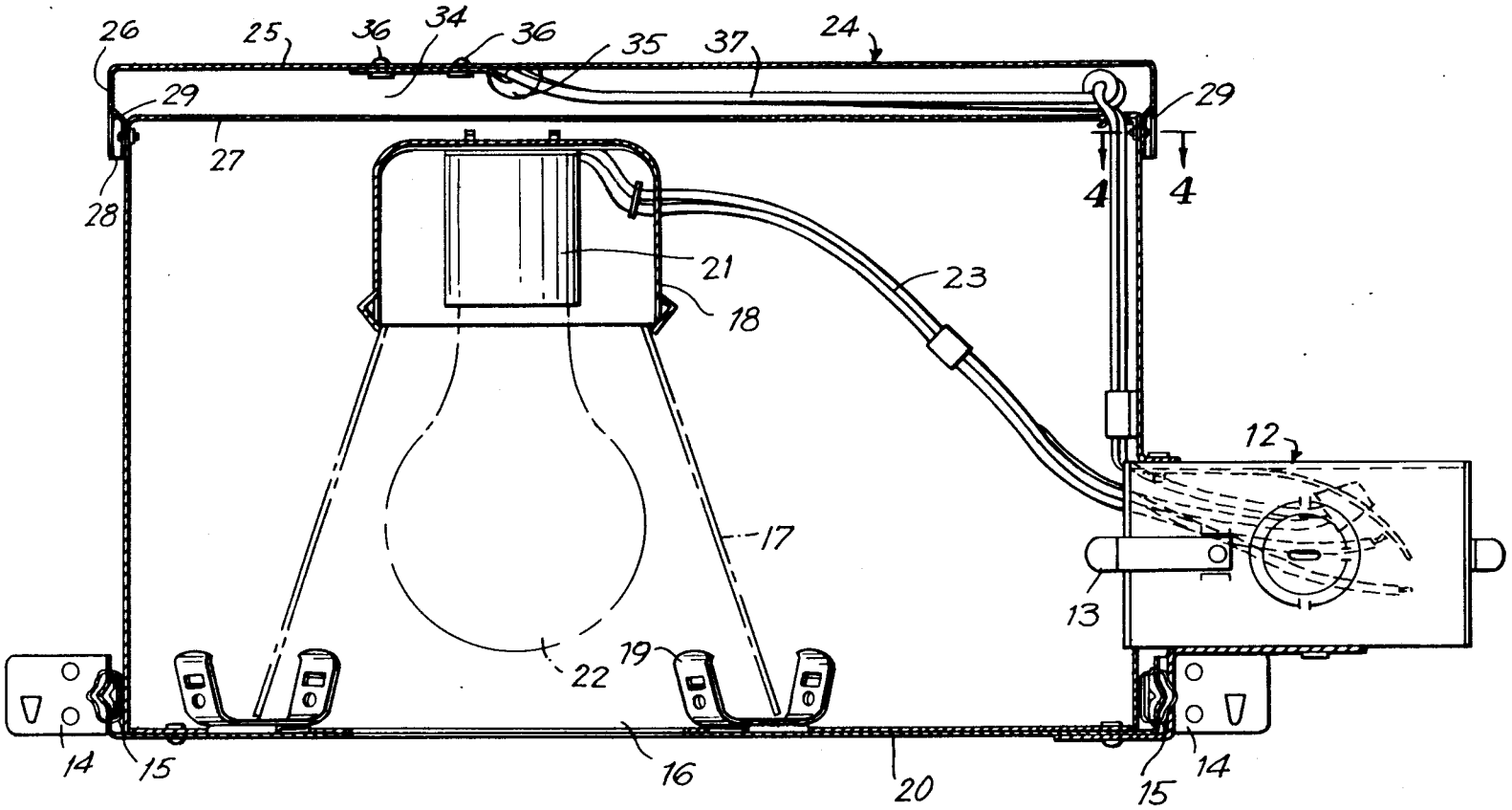
FIG. 2 is a magnified vertical section taken on line 2—2 of FIG. 1.

As best seen from FIG. 2 the fixture may include conventional means for connecting the same to a ceiling structure, such as by way of example mounting flanges 14 which enable the fixture to be supported between joists, or alternatively to be supported on hanger rods 15 which lie within complimental slots formed on the flanges, the rods being supported on structural members previously mounted on the ceiling.

Since the mounting flanges and associated mechanisms form no part of the present invention, these details have been eliminated from FIG. 1.

The housing 10 includes a downwardly open central aperture 16 through which a reflector mechanism 17 carrying socket support cup 18 may be releasably mounted. The reflector mechanism may be supported between retainer clips 19 pivotably mounted to bottom wall 20 of the housing defining opening 16. Details of the spring clips 19 are disclosed in U.S. Pat. No. 4,313,154 issued Jan. 26, 1982 and thus details thereof, and the manner in which they releasably support reflector 17 need not be here related. The cup member 18 includes a socket 21 of conventional design for holding an incandescent bulb 22. The socket 21 is connected as by conductors 23 to the electrical mains which in turn are disposed within junction box 12.

As thus far described, the fixture is entirely conventional. Characterizing features of the invention reside in the provision of a cover member 24 mounted to the housing 10 in a manner hereinafter more particularly described.

The cover member 24 conforms, in plan, to the configuration of the housing and includes a top 25 and a surrounding skirt 26, the skirt 26 extending to a level below the top wall portions 27 of the housing. The skirt 26 outwardly laps the walls 11 of the housing and defines between the skirt 26 and sidewalls 11 a circumferential downwardly open slot 28.

Figure 3:
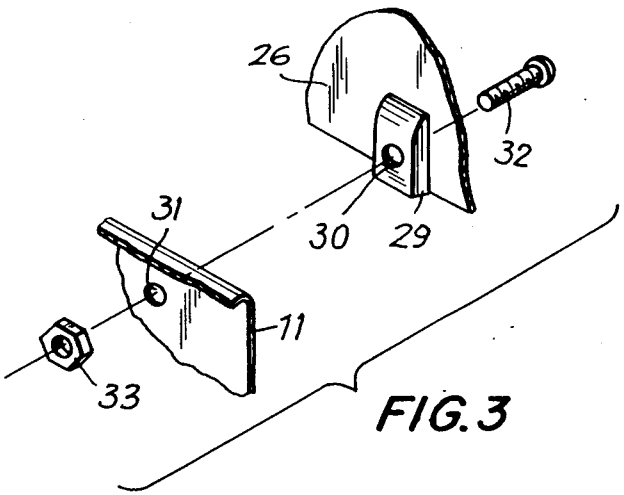
FIG. 3 is an exploded fragmentary view depicting the manner in which the fixture cover is mounted to the fixture.
Figure 4:
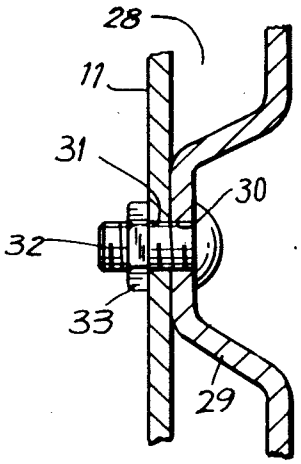
FIG. 4 is a horizontal section taken on the line 4—4 of FIG. 2.

As best appreciated from FIGS. 3 and 4, the cover 24 is secured to the housing in a manner which minimizes heat transfer between the housing and cover member. More particularly, a pair of projections 29 are struck inwardly at diametrically spaced positions of the skirt 26. The projections 29 include through going apertures 30 which in the mounted condition of the cover to the housing align with complimental apertures 31 formed on opposed side walls 11 of the housing. The cover is mounted to the housing as by bolt 32 which is passed through aligned apertures 30 and 31 the bolt being threaded into complimental nut 33.

As will be evident from the above description, the cover 24 is securely mounted to the housing at two spaced, diametrically opposed positions. Since there is minimal metal to metal contact between the skirt 26 of the cover and the side walls 11 of the housing, there is a minimum of heat conduction from the housing to the cover 24. It will be further recognized that there is defined between cover 24 and the top wall portion 27 of the housing a space or chamber 34.

A thermal sensor 35, having a metallic body portion is disposed within the space 34, the sensor being mounted to the top wall 25 of the cover member as by rivets 36.

The operation of the device will be apparent from the preceding description. In its mounted position, the lower most wall 20 of the housing will lie subtantially flush with the lower surface of the ceiling. The thermal sensor 35 is connected to the junction box 12 as by conductors 37. The sensor 35 is wired in series with the lines running to the bulb, (i.e. lines 23), such that when the sensor is triggered, current flow to the bulb is interrupted.

In the mounted position of the fixture, it is possible for flammable material to come in contact with external portions of the fixture. As a practical matter, the uppermost portions of the fixture are always at the highest temperatures due, of course, to the tendency of heat to rise. Accordingly, any flammable materials resting against the fixture will necessarily rest against the cover member 24. The temperature of the cover member 24 will normally be substantially lower than the temperature of the upper wall portion 27 of the housing proper due to the displacement of the cover member from the heat of the bulb and due to the further fact that air entrapped in the chamber 34 is permitted to flow outwardly through the circumferential slot 28. Also, a previously noted, heat transferred from the upper wall 27 to the cover 24 is minimized due to the limited metal to metal contact of these components. It will thus be seen, that the thermal sensor 35 will be triggered to interrupt the circuit to the bulb 22 only if the temperature within the space 34 reaches a predetermined high level signifying the danger of combustion of materials surrounding the housing. Thus, the sensor is disposed in a position which accurately reflects the temperature which would be transmitted to objects surronding and possibly engaging the cover member 24. Accordingly, the possibility of false triggering of the thermal sensor is minimized while still assuring that in the event of undue heat build-up which is relfected by high temperatures of the top portion 25 of cover member 24, the circuit to the bulb will be interrupted.

As will be apparent to those skilled in the art and familiarized with the instant disclosure, numerous variations in details of construction may be made without departing from the spirit of the invention. Accordingly, the invention is to be broadly construed within the scope of the appended claims.

What is claimed as new and sought to be protected by letters patent is:

1. A recessed incandescent ceiling light fixture having heat sensing means comprising a housing having side walls and a generally planar top wall, a reflector assembly mounted in said housing, socket means in said housing for the reception of an incandescent bulb, said housing having a junction box mounted on an external surface thereof, a metallic cover member disposed in parallel spaced relation to said top wall portion, said cover member including a depending skirt portion overlapping and spaced from said side walls, said skirt portion and side wall defining there between a downwardly directed circumferential slot, attchement means spanning said slot and connecting said cover member and housing at a plurality of spaced positions, and a heat sensor member fixed to said cover member and disposed in the space between said cover member and top wall, said sensor member and cover member being in heat conductive relation whereby said sensor is maintained substantially at the temperature of said cover member.

2. A light fixture in accordance with claim 1 wherein said sensor member includes a metallic body portion, said sensor member having said body portion in heat conductive relation to said cover member, said sensor being spaced above and clear of contact with said top wall portion of said housing.

3. An apparatus in accordance with claim 2 wherein said attachment means provides minimal metal to metal contact between said side walls of said hosing and said skirt portion.

* * * * *